US011154973B2

(12) United States Patent
O'Donnell

(10) Patent No.: US 11,154,973 B2
(45) Date of Patent: Oct. 26, 2021

(54) MODULAR TOOL APPARATUS

(71) Applicant: Michael O'Donnell, San Diego, CA (US)

(72) Inventor: Michael O'Donnell, San Diego, CA (US)

( * ) Notice: Subject to any disclaimer, the term of this patent is extended or adjusted under 35 U.S.C. 154(b) by 0 days.

(21) Appl. No.: 17/058,997

(22) PCT Filed: Sep. 9, 2019

(86) PCT No.: PCT/IB2019/057596
§ 371 (c)(1),
(2) Date: Nov. 25, 2020

(87) PCT Pub. No.: WO2020/049547
PCT Pub. Date: Mar. 12, 2020

(65) Prior Publication Data

US 2021/0245352 A1 Aug. 12, 2021

Related U.S. Application Data

(60) Provisional application No. 62/728,195, filed on Sep. 7, 2018.

(51) Int. Cl.
*B25F 1/04* (2006.01)
*B26B 1/04* (2006.01)

(52) U.S. Cl.
CPC . *B25F 1/04* (2013.01); *B26B 1/04* (2013.01)

(58) Field of Classification Search
CPC ..... B25F 1/02; B25F 1/04; B26B 1/02; B26B 1/04
See application file for complete search history.

(56) References Cited

U.S. PATENT DOCUMENTS

| | | | |
|---|---|---|---|
| 1,087,342 | A | 2/1914 | Yerzley |
| 7,716,839 | B2 | 5/2010 | Onion et al. |
| 2003/0126748 | A1 | 7/2003 | Cachot |
| 2015/0190915 | A1 | 7/2015 | Grysen, Jr. et al. |

*Primary Examiner* — David B. Thomas

(57) ABSTRACT

A modular tool apparatus includes at least one handle, at least one utility tool, at least one attachment channel, at least one pivot pin, and at least one lever. The pivot pin includes a D-shaped cross section and rotatably connected to the handle thus enabling the foldable connection between the handle and the utility tool. The lever is terminally connected to the pivot pin and allows the pivot pin to be configured in between a locked position and an unlocked position. The attachment channel laterally traverses into the utility tool as the attachment channel is rotatably engaged around the pivot pin. The utility tool is foldably attached to the handle through the attachment channel and the pivot pin, wherein the D-shaped cross section of the pivot pin and a matching profile of the attachment channel allow the utility tool to be installed or removed from the pivot pin.

20 Claims, 19 Drawing Sheets

SECTION B-B

SECTION C-C

SECTION D-D

SECTION E-E

SECTION F-F

SECTION G-G

MODULAR TOOL APPARATUS

FIELD OF THE INVENTION

The present invention generally relates to a multi-tool that foldably utilizes several individual utility tools. More specifically, the present invention functions as a modular tool apparatus so that at least one utility tool body can be removably attached to at least one handle body through at least one pivot pin.

BACKGROUND OF THE INVENTION

Modular tools, also known as multi-tool, provides a wide of range of functionality and are used for varied applications. In general, modular tools comprise a handle structure as various tools are stored within the handle structure. The handle structure is often a hollow, portable structure, either modular or fixed, with the various tools attached through a pivoting mechanism. The pivoting mechanism allows users to retrieve the various tools by rotating the tools around the pivoting mechanism out of the handle structure. While this traditional structure of modular tools is versatile and provides great functionality, the traditional structure can also provide various disadvantages. For example, it is a common problem for the pivoting mechanisms of modular tools to get stuck or break down if the users do not properly perform maintenance on the modular tools. Because of the multiple tools being often positioned near each other, the tools can get stuck inside/outside the handle structure of the modular tool, making it difficult for users to retrieve/store the various tools away. Further, the various tools provided on the modular tool can only be rotated around the pivoting mechanisms but cannot be removed from the handle structure of the modular tool. Most modular tools provide a structure that allow users to easily utilize the various tools while still attached to the handle structure, but sometimes it's more appropriate to utilize the various alone and separate from the handle structure of the modular tools. For example, when working in a hard to reach area, it's better to work with the single tool alone rather than holding the whole modular tool with the single tool attached to the case of the modular tool. Thus, a pivoting mechanism which allows the various tools provided in a modular tool to be rotated in/out of the handle structure of the modular tool as well as to be removed from the case of the modular tool is beneficial and necessary.

An objective of the present invention is to provide a modular tool apparatus. The modular tool apparatus is preferably design for modular tools to be rotated around the pivot pin as well as to be removed from the structure of the modular tool apparatus. At least one utility tool component can be securely rotated around the pivot pin that is rotatably connected to the structure of the modular tool apparatus while a separate lever holds the pivot pin in place. The lever can further be rotated allowing the at least one utility tool component to be removed from the pivot pin. Furthermore, the structure of the modular tool apparatus has a leaf-spring locking mechanism that applies tension to the at least one utility tool component so that the at least one utility tool component can be securely configured into folded or unfolded position.

SUMMARY OF THE INVENTION

The present invention is a modular tool apparatus and comprises a pivot pin that is preferably a D-shaped cross section with one or more utility tools having matching voids.

The matching voids of the one or more utility tools allow the one or more utility tools to be installed or removed from the pivot pin. Since the matching voids only match the D-shaped cross-section of the pivot pin at a specific angle, the one or more utility tools are secure until the pivot pin and the one or more utility tools are rotated to matching angles. A lever of the modular tool apparatus allows the pivot pin to be rotated. With the lever being configured in a locked position, the one or more utility tools can be rotated greater than 180 degrees without the voids on the one or more utility tools matching the D-shaped cross-section of the pivot pin. A leaf-spring/locking mechanism can further be provided in the modular tool apparatus. The leaf-spring/locking mechanism provides pressure against the one or more utility tools for added security/stability during folded/unfolded position. With the lever being configured in an unlocked position, the one or more utility tools can be rotated to a point where the voids match the D-shaped cross-section of the pivot pin and can be removed.

DETAIL DESCRIPTIONS OF THE INVENTION

Figure 1:
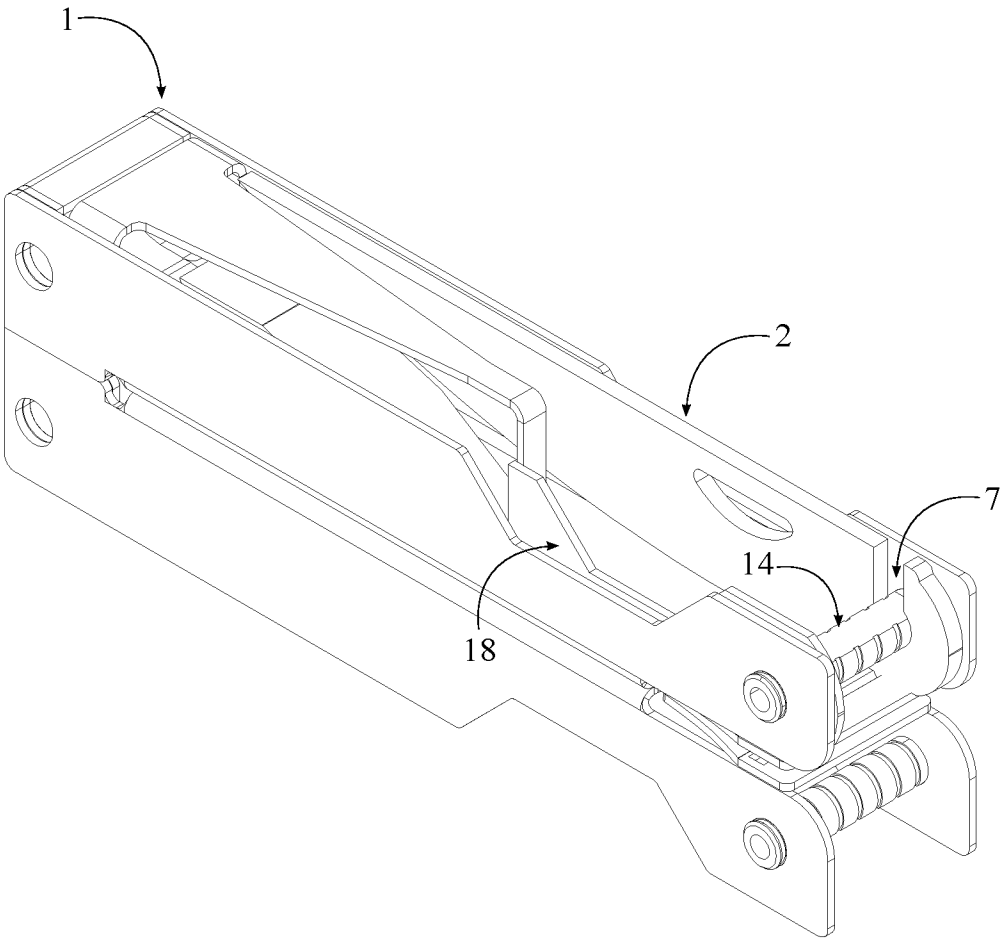
FIG. 1 is a perspective view of the present invention, wherein the utility tool and the lever are folded within the handle.
Figure 2:
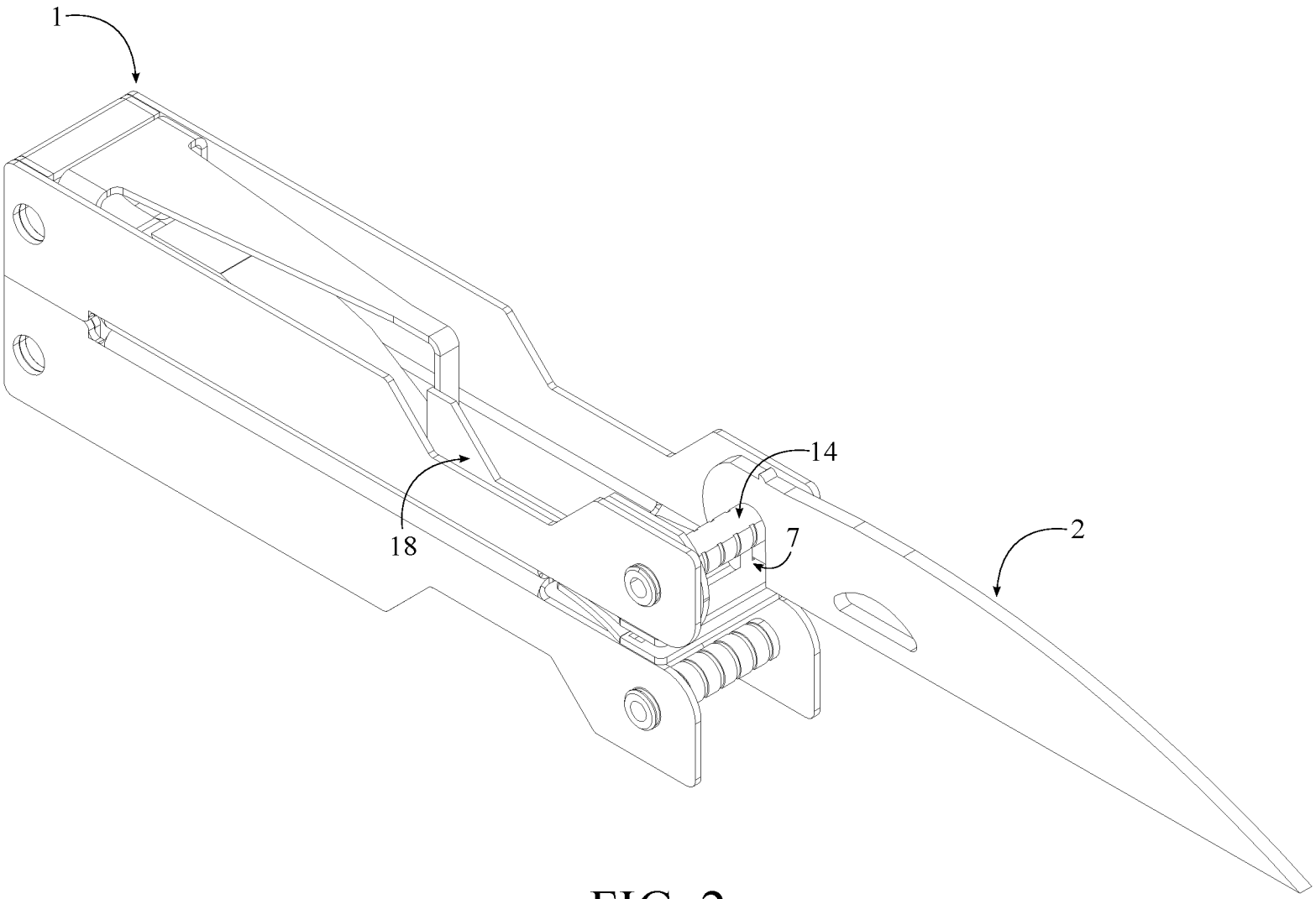
FIG. 2 is a perspective view of the present invention, wherein the utility tool is folded out of the handle and the lever is folded within the handle.
Figure 3:
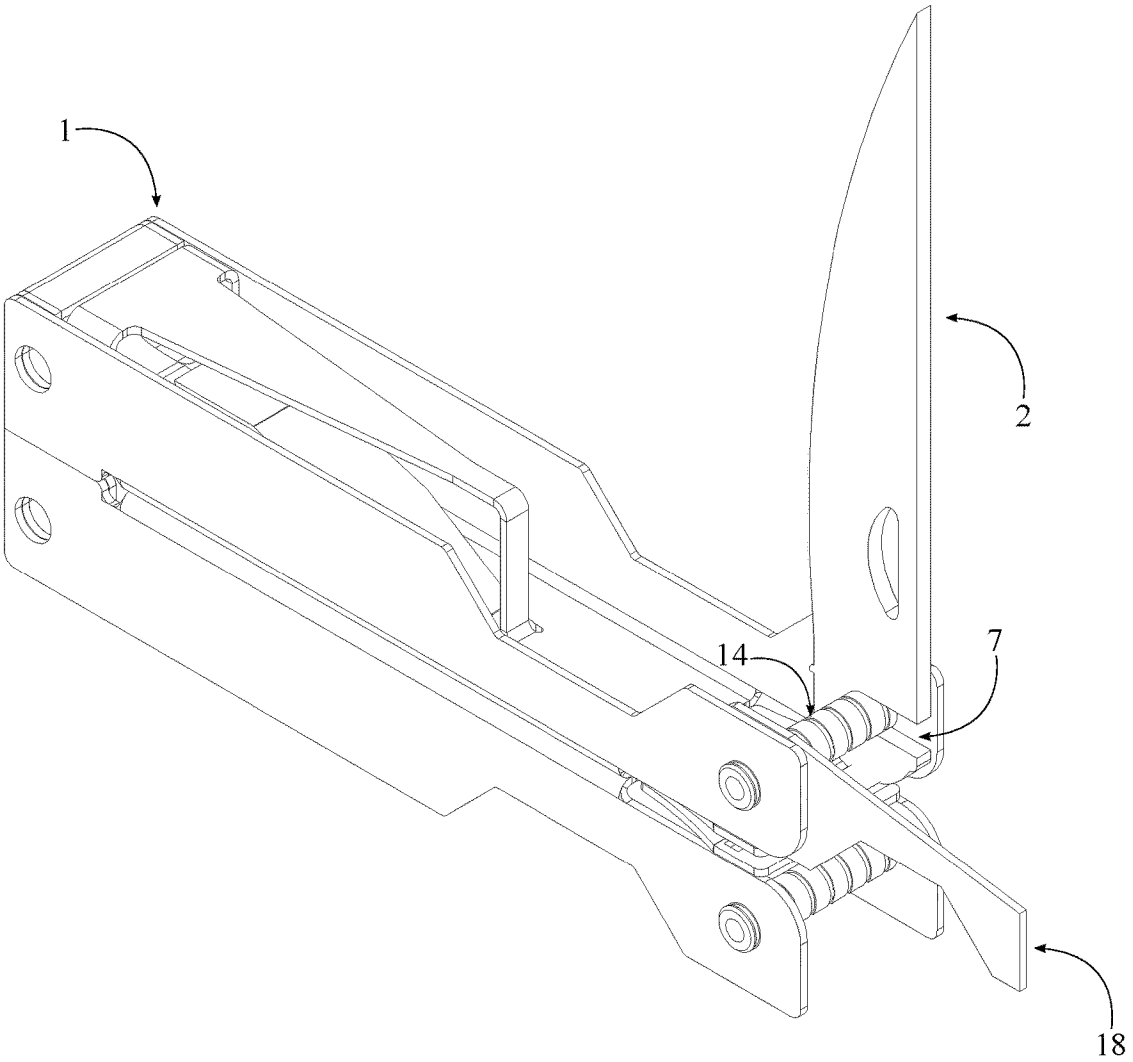
FIG. 3 is a perspective view of the present invention, wherein the utility tool and the lever are folded out of the handle.
Figure 4:
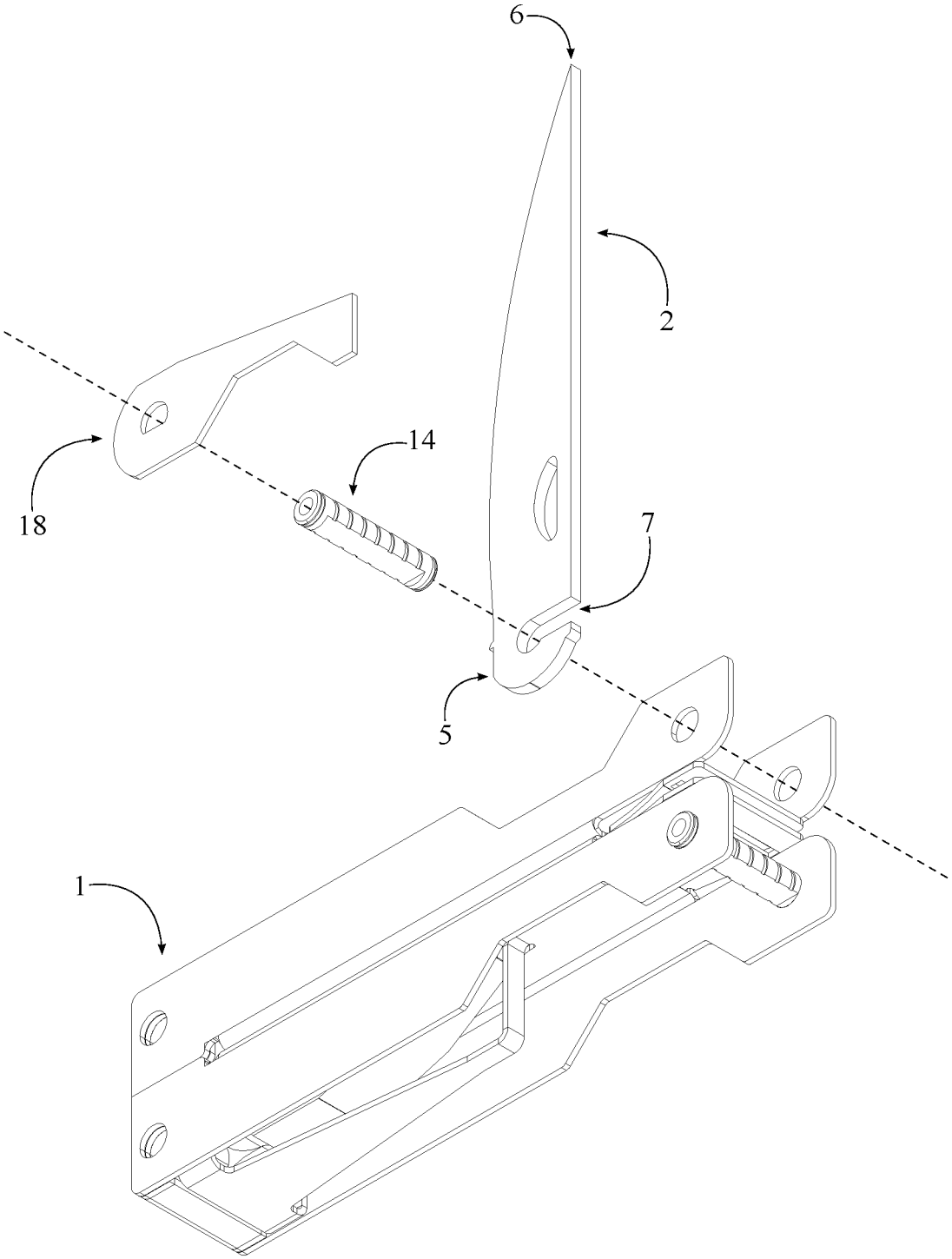
FIG. 4 is a bottom exploded perspective view of the present invention.

All illustrations of the drawings are for the purpose of describing selected versions of the present invention and are not intended to limit the scope of the present invention.

The present invention is a modular tool apparatus is a portable hand tools that combines one or several individual functions in a single unit. More specifically, the present invention allows the user to foldably store and rotatably remove a tool component for repair or replacement.

The present invention comprises at least one handle 1, at least one utility tool 2, at least one attachment channel 7, at least one D-shaped pivot pin 14, and at least one lever 18 as shown in FIG. 1-4. In reference to the general configuration of the present invention, the D-shaped pivot pin 14 is rotatably connected to the handle 1 so that the D-shaped pivot pin 14 is able to function as the primary connecting component between the handle 1 and the utility tool 2. The lever 18 being terminally connected to the D-shaped pivot pin 14 thus enabling the rotational movement of the D-shaped pivot pin 14 about the handle 1. The attachment channel 7 laterally traverses into the utility tool 2 and provide a void within the utility tool 2 so that the attachment channel 7 can be rotatably engaged around the D-shaped pivot pin 14. As a result, the utility tool 2 is foldably attached to the handle 1 through the attachment channel 7 and the D-shaped pivot pin 14. In other words, the utility tool 2 can be foldably stored within the handle 1 for storage purpose or can be foldably extended out of the handle 1 to usage.

Figure 5:
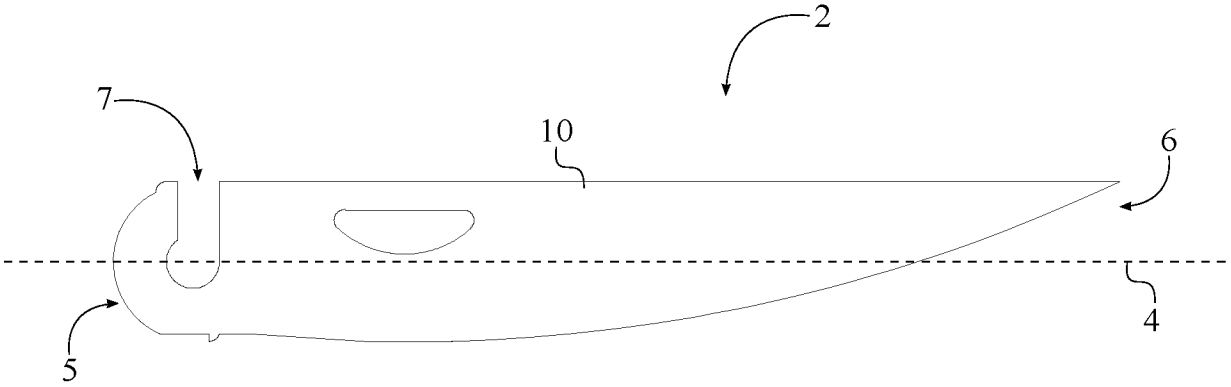
FIG. 5 is a side view of the utility tool of the present invention.

The utility tool 2 can include, but is not limited to, a screwdriver, a ruler, a metal or wood filer, a knife blade, a saw blade, a can/bottle opener, and a scissor. In reference to FIG. 5, the utility tool 2 comprises a main body 3, a longitudinal axis 4, a fixed end 5, and a free end 6. The main body 3 delineate or complete the shape/configuration of the utility tool 2. For example, when the utility tool 2 is a knife blade, the main body 3 resembles a rigid body with a cutting edge. The fixed end 5 and the free end 6 are oppositely positioned of each other about the main body 3 as the longitudinal axis 4 of the utility tool 2 is extended through the fixed end 5 and the free end 6. The attachment channel 7 is positioned adjacent to the fixed end 5 thus enabling the utility tool 2 to be attached and operated about the D-shaped pivot pin 14. The free end 6 is positioned offset of the D-shaped pivot pin 14 so that the free end 6 can be rotated about the D-shaped pivot pin 14.

Figure 6:
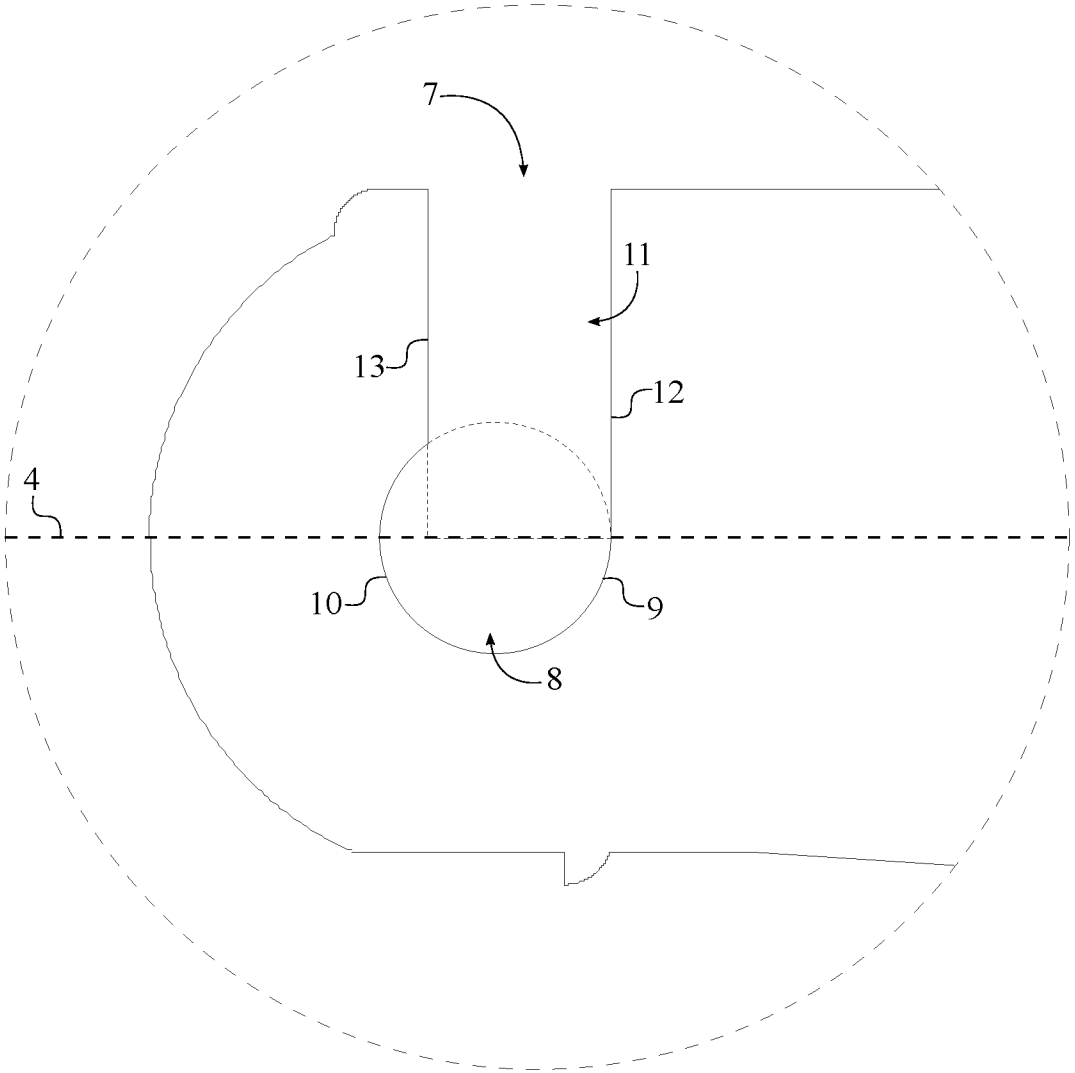
FIG. 6 is a detailed view of the attachment channel of the present invention, showing the circular section and the rectangular section.

The attachment channel 7 that is rotatably engaged around the D-shaped pivot pin 14 comprises a circular section 8 and a rectangular section 11 as shown in FIG. 6. The circular section 8 that allows the utility tool 2 to be rotated about the D-shaped pivot pin 14 is concentrically positioned onto the longitudinal axis 4 of the utility tool 2 and traverses through the main body 3. The rectangular section 11 that allows the utility tool 2 to be inserted in or removed from the D-shaped pivot pin 14 laterally traverses into the main body 3 and is extended into the longitudinal axis 4 of the utility tool 2.

Figure 7:
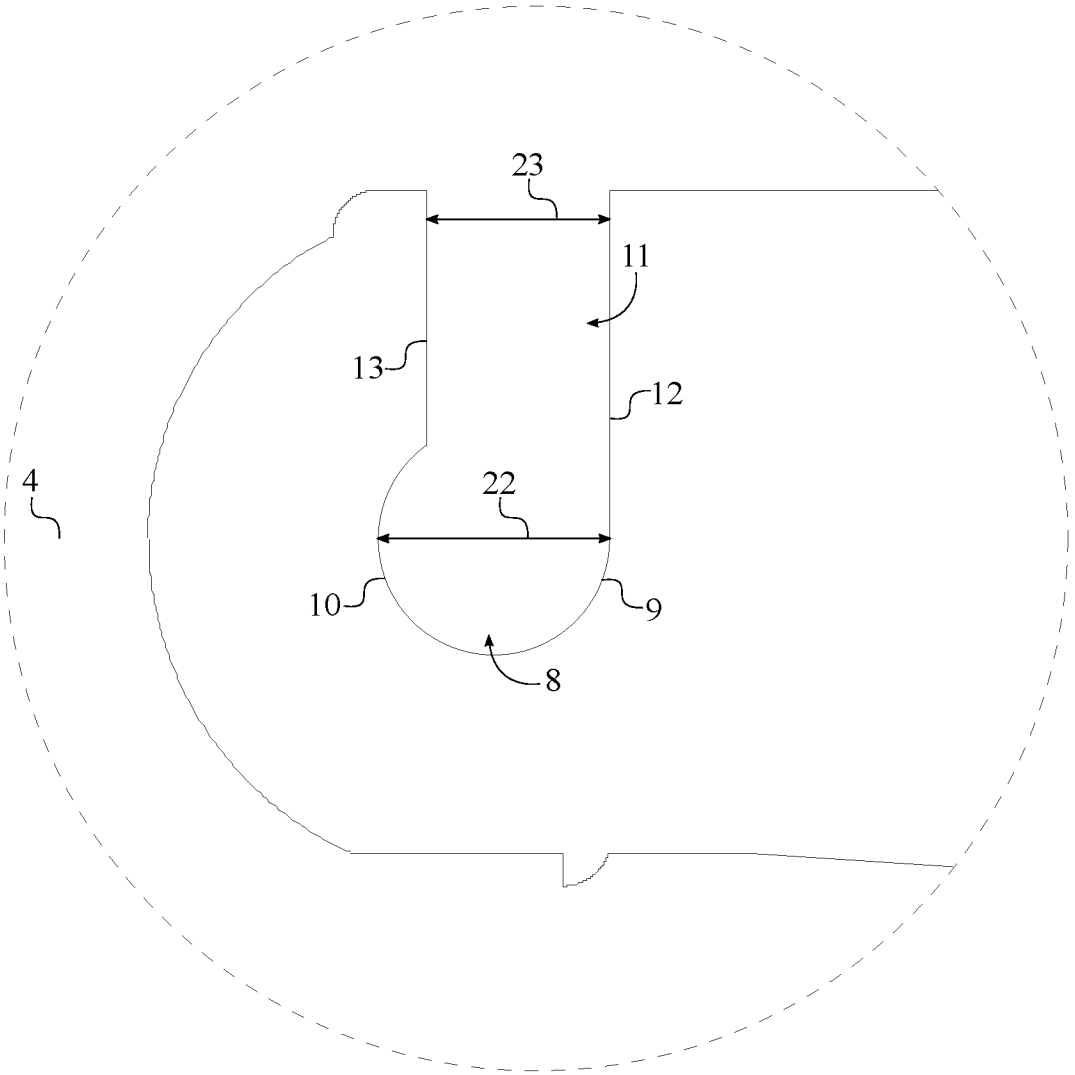
FIG. 7 is a detailed view of the attachment channel of the present invention, showing the diameter of the circular section is larger than the distance between the first lengthwise edge and the second lengthwise edge.

The circular section 8 comprises a first half 9 and a second half 10, and the rectangular section 11 comprises a first lengthwise edge 12 and a second lengthwise edge 13 as shown in FIG. 6-7. In reference to further explanation of the attachment channel 7, the first lengthwise edge 12 and the second lengthwise edge 13 are positioned parallel to each other. The first lengthwise edge 12 is tangentially positioned to the first half 9 as the first lengthwise edge 12 intersect the longitudinal axis 4 of the utility tool 2. The second lengthwise edge 13 is laterally intercepted about the second half 10, wherein a diameter 22 of the circular section 8 is larger than a distance 23 between the first lengthwise edge 12 and the second lengthwise edge 13. Resultantly, a chord of the circular section 8 extends beyond the second lengthwise edge 13 and positioned opposite of the first lengthwise edge 12.

Figure 9:
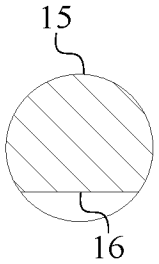
FIG. 9 is a cross section view of D-shaped pivot pin of the present invention taken along line A-A of FIG. 8.
Figure 8:
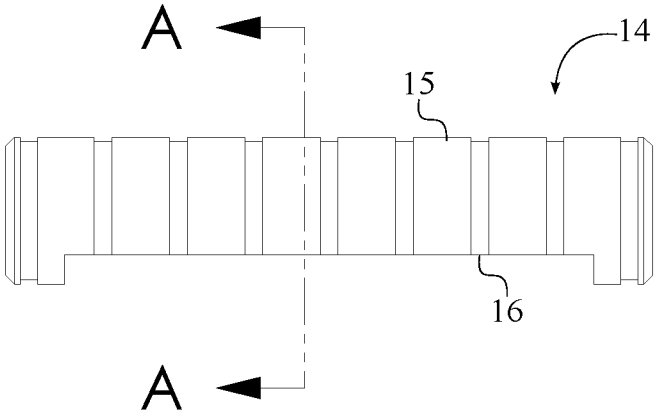
FIG. 8 is a side view of D-shaped pivot pin of the present invention, showing the plane upon which a cross sectional view is taken shown in FIG. 9.
Figure 11:
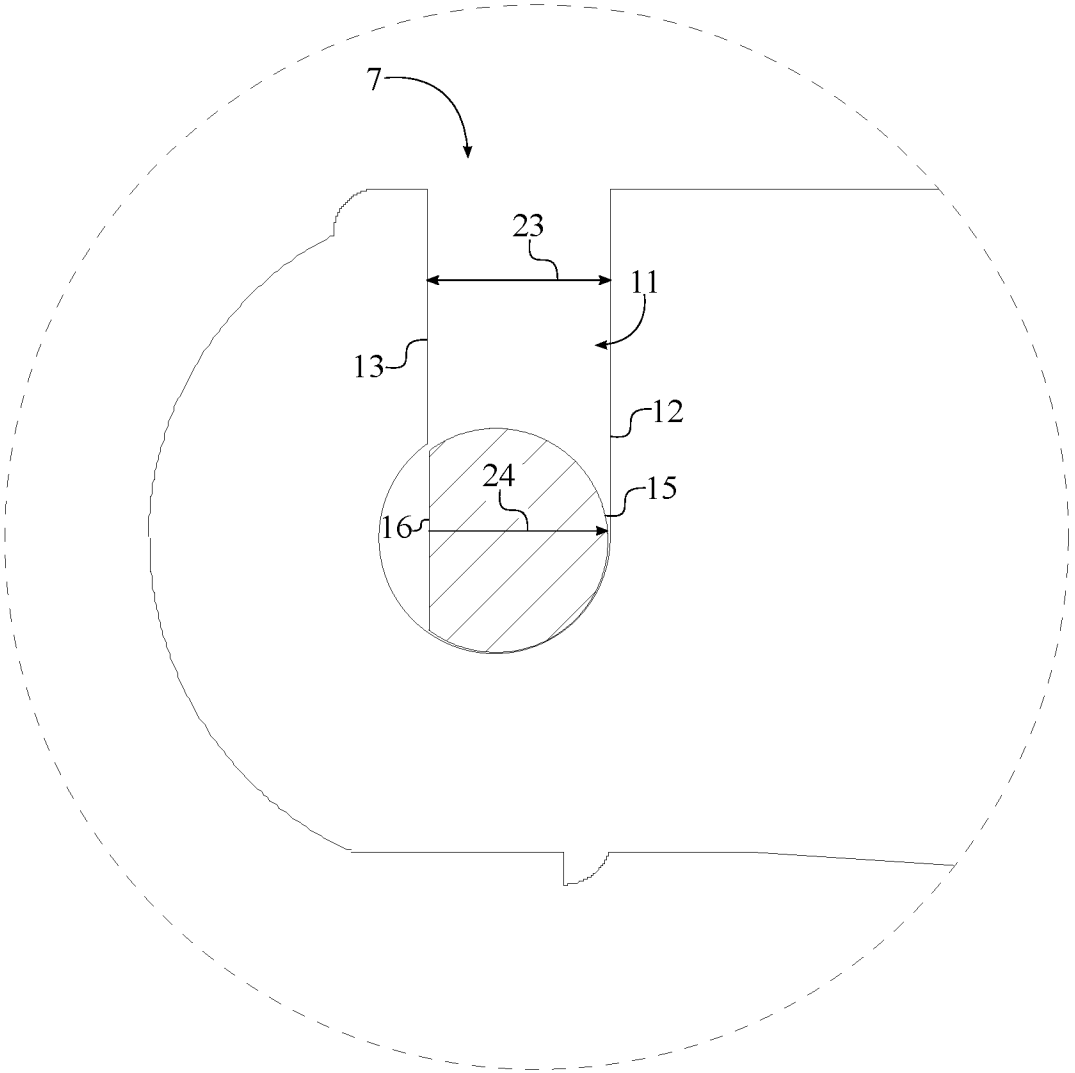
FIG. 11 is a detailed view of the attachment channel and the D-shaped pivot pin of the present invention, showing the height of the arc wall is smaller than the distance between the first lengthwise edge and the second lengthwise edge.

In reference to FIG. 8-9, a cross section of the D-shaped pivot pin 14 comprises an arc wall 15 and a straight wall 16 as the straight wall 16 is terminally connected to the arch wall. More specifically, end points of the straight wall 16 are terminally connected to end points of the arc wall 15 thus delineating the cross sectional profile of the D-shaped pivot pin 14. Furthermore, the arc wall 15 is a major arc so that the D-shaped pivot pin 14 is able to concentrically rotate within the circular section 8 without any misalignments. Furthermore, the D-shaped pivot pin 14 is only able to slide through the rectangular section 11 at a specific angle as the orientation and configuration of the D-shaped pivot pin 14 regulates the movement of the utility tool 2. In order to accomplish the movement of the D-shaped pivot pin 14 within the attachment channel 7, a height 24 of the arc wall 15 has to be smaller than the distance 23 between the first lengthwise edge 12 and the second lengthwise edge 13 wherein the height 24 of the arc wall 15 is perpendicularly positioned to the straight wall 16 and bisects the cross section of the D-shaped pivot pin 14 as shown in FIG. 11.

Figure 10:
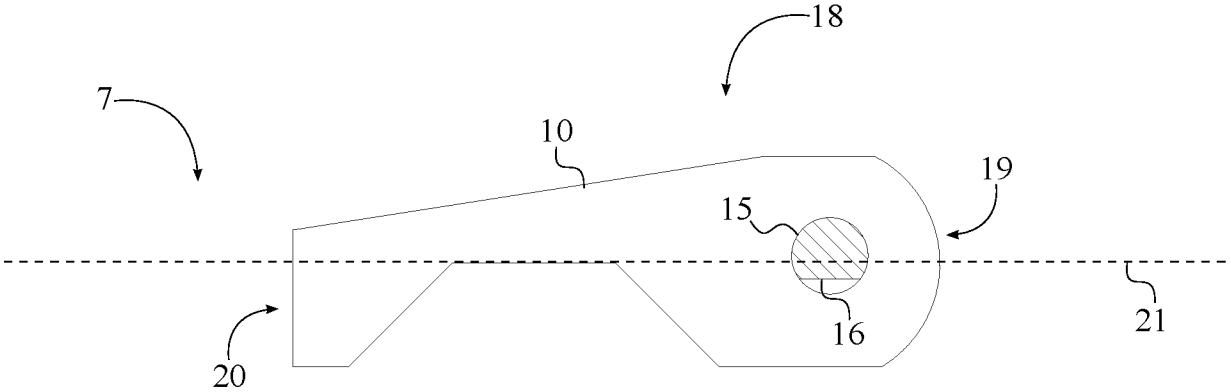
FIG. 10 is a side view of the lever of the present invention, showing the cross section of the D-shaped pivot pin attachment to the lever.

The lever 18 enables the rotational movement of the D-shaped pivot pin 14 about the handle 1 so that the utility tool 2 can be engaged or disengaged from the handle 1. In reference to FIG. 10, the lever 18 comprises a longitudinal axis 21, a first end 19, and a second end 20. The first end 19 and the second end 20 are oppositely positioned of each other about the lever 18 as the longitudinal axis 21 of the lever 18 is extended though the first end 19 and the second end 20. The first end 19 is terminally connected to the D-shaped pivot pin 14 thus transferring the rotational movement of the lever 18 to the D-shaped pivot pin 14. The second end 20 allows the user to comfortably grasp the lever 18 so that the lever 18 can be rotated. The longitudinal axis 21 of the lever 18 is positioned parallel to the straight wall 16 of the D-shaped pivot pin 14 so that the D-shaped pivot pin 14 can be rotated to any specific angle about the handle 1, as the specific angle can range from 0-180 degrees. For example, when the second end 20 is positioned within the handle 1, the user can freely extend the utility tool 2 out of the handle 1 for usage or fold the utility tool 2 into the handle 1 for storage as the utility tool 2 is rotatably engaged around the D-shaped pivot pin 14. However, when the second end 20 is parallelly extended out of the handle 1, the user can extend the utility tool 2 perpendicular to the handle 1 for removal or insertion of the utility tool 2 as the rotation of the D-shaped pivot pin 14 enables the attachment channel 7 to slide in and out of the D-shaped pivot pin 14.

Figure 12:
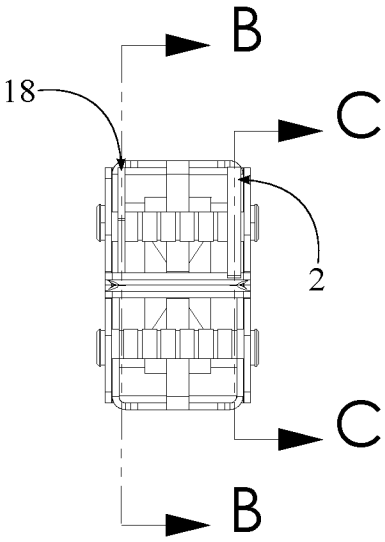
FIG. 12 is a side view of the present invention within the first locked position, showing the plane upon which a cross sectional view is taken shown in FIG. 13 and FIG. 14.
Figure 13:
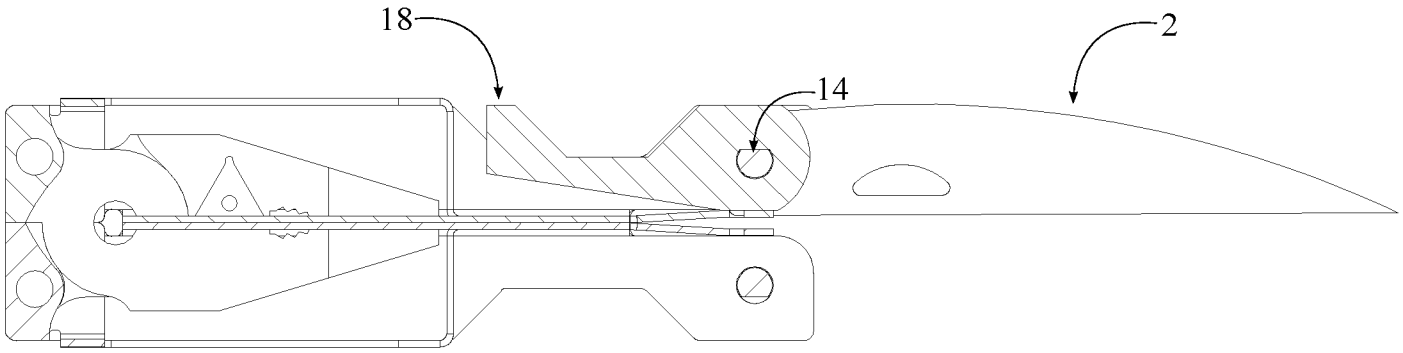
FIG. 13 is a cross section view of the present invention taken along line B-B of FIG. 12, showing the positioning of the lever within the first locked position.
Figure 14:
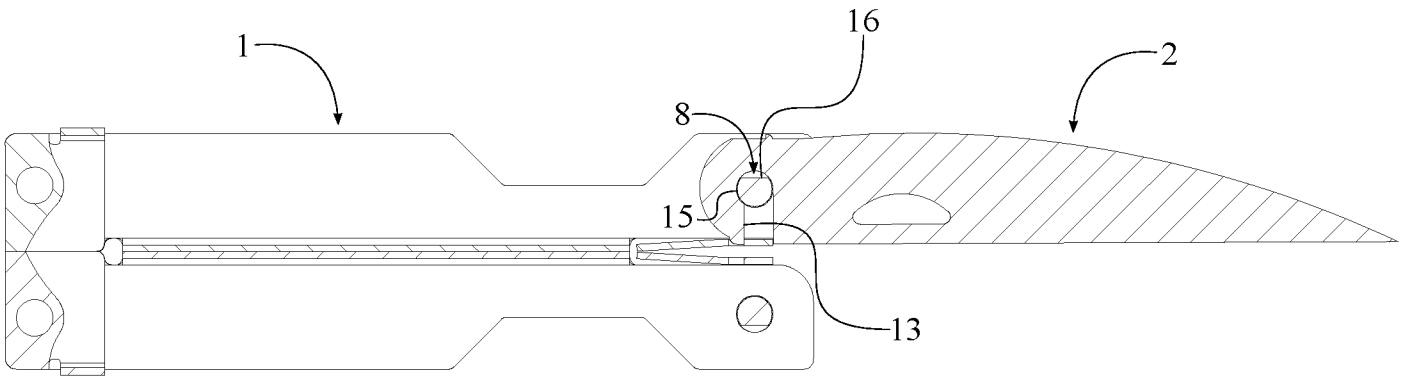
FIG. 14 is a cross section view of the present invention taken along line C-C of FIG. 12, showing the positioning of the utility tool within the first locked position.

In reference to FIG. 12-14, the attachment channel 7 and the D-shaped pivot pin 14 are configured into a first locked position thus enabling the usage of the utility tool 2 while the utility tool 2 is folded out of the handle 1. The first locked position allows the utility tool 2 to be utilized within the present invention as the utility tool 2 is fully extended out of the handle 1. More specifically, the arc wall 15 is concentrically encircled within the circular section 8 so that the D-shaped pivot pin 14 is able to rotate about the circular section 8 of the attachment channel 7. However, the straight wall 16 is angularly positioned to the second lengthwise edge 13 of the rectangular section 11. Due to the angular positioning of the straight wall 16, at least some parts of the arc wall 15 is continuously in contact with a connection point of the second half 10 and the second lengthwise edge 13. Due to the obstruction between the D-shaped pivot pin 14 and the connection point, the utility tool 2 can be rotatably secured around the D-shaped pivot pin 14 when the utility tool 2 is angularly positioned to the handle 1 during the folding process of the utility tool 2.

Figure 15:
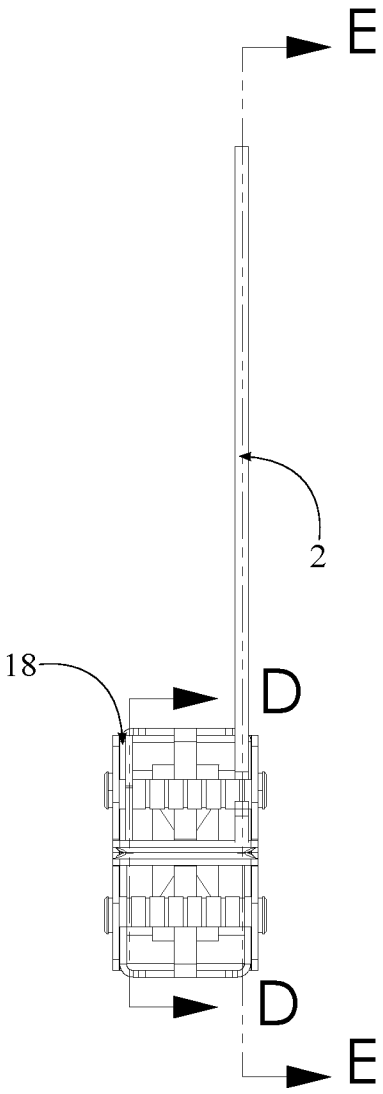
FIG. 15 is a side view of the present invention within the second locked position, showing the plane upon which a cross sectional view is taken shown in FIG. 16 and FIG. 17.
Figure 16:
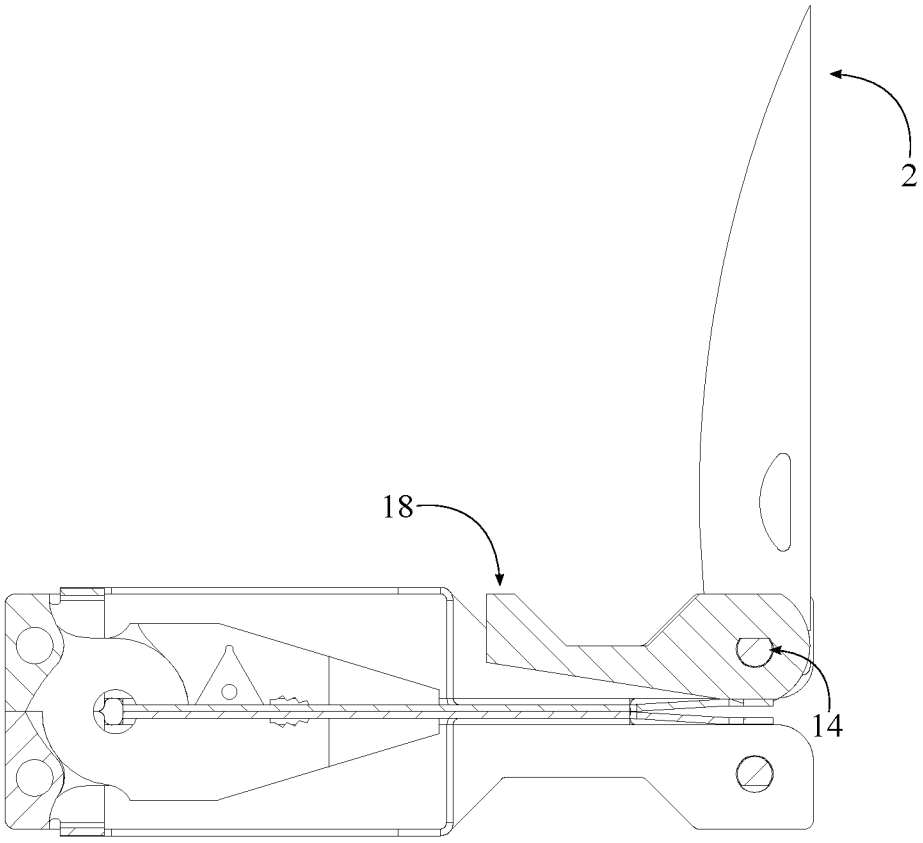
FIG. 16 is a cross section view of the present invention taken along line D-D of FIG. 15, showing the positioning of the lever within the second locked position.
Figure 17:
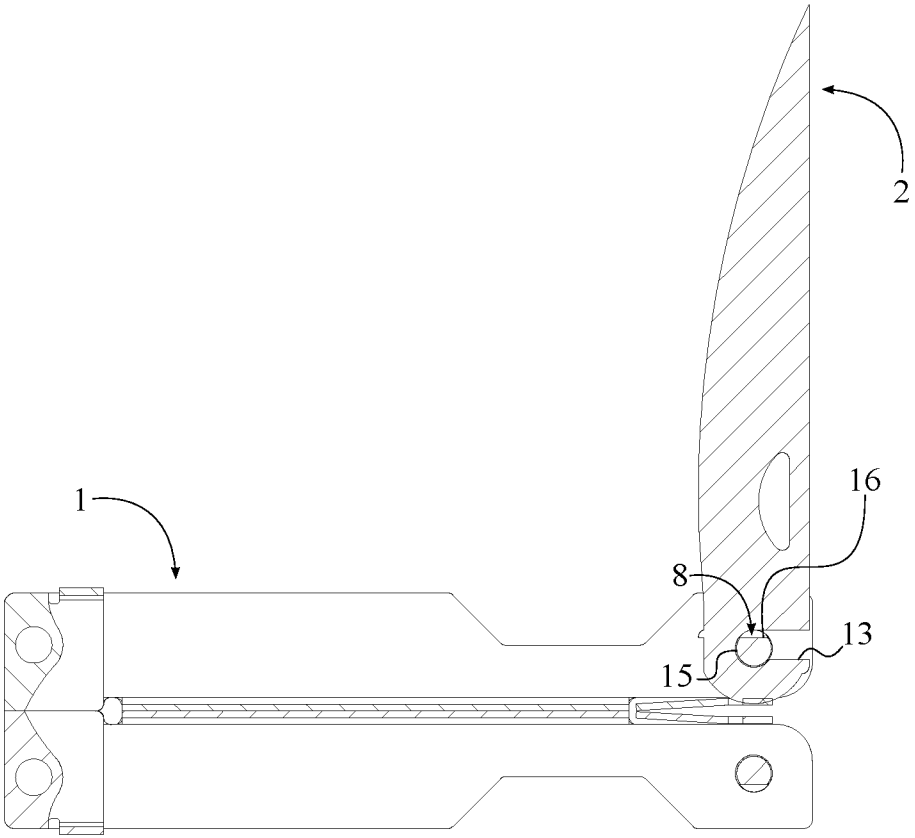
FIG. 17 is a cross section view of the present invention taken along line E-E of FIG. 15, showing the positioning of the utility tool within the second locked position.

In reference to FIG. 15-17, the attachment channel 7 and the D-shaped pivot pin 14 are configured into a second locked position thus enabling the rotational movement of the utility tool 2 out of the handle 1. The second locked position allows the utility tool 2 to be rotatably moved around the D-shaped pivot pin 14 as the utility tool 2 is folded in and out of the handle 1. More specifically, the arc wall 15 is concentrically encircled within the circular section 8 so that the D-shaped pivot pin 14 is able to rotate about the circular section 8 of the attachment channel 7. However, the straight wall 16 is positioned parallel to the second lengthwise edge 13 of the rectangular section 11 as the straight wall 16 is positioned offset to the second lengthwise edge 13 and positioned adjacent to the first lengthwise edge 12. Due to the positioning of the straight wall 16, the arc wall 15 is fully engaged within the first half 9 and the second half 10. Since the second lengthwise edge 13 is laterally intercepted about the second half 10, the utility tool 2 can be rotatably secured around the D-shaped pivot pin 14 when the utility tool 2 is positioned parallel to the handle 1 and extended out of the handle 1.

Figure 18:
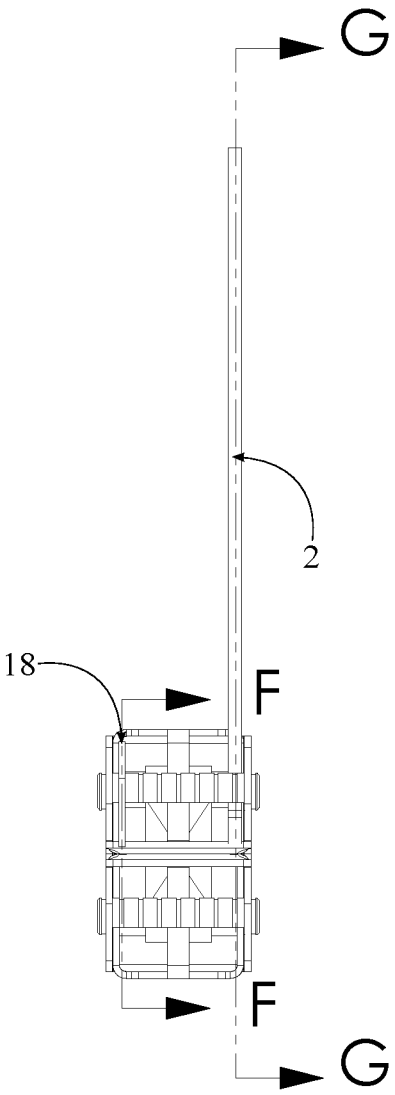
FIG. 18 is a side view of the present invention within the unlocked position, showing the plane upon which a cross sectional view is taken shown in FIG. 19 and FIG. 20.
Figure 19:
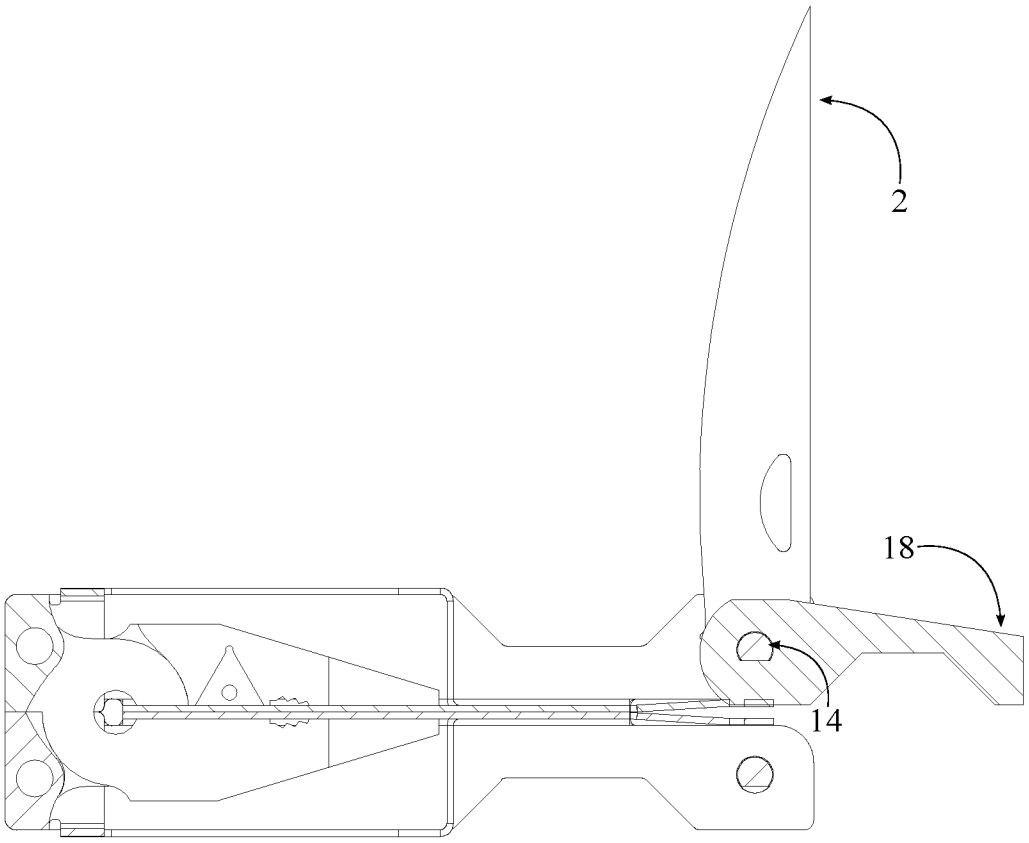
FIG. 19 is a cross section view of the present invention taken along line F-F of FIG. 18, showing the positioning of the lever within the unlocked position.
Figure 20:
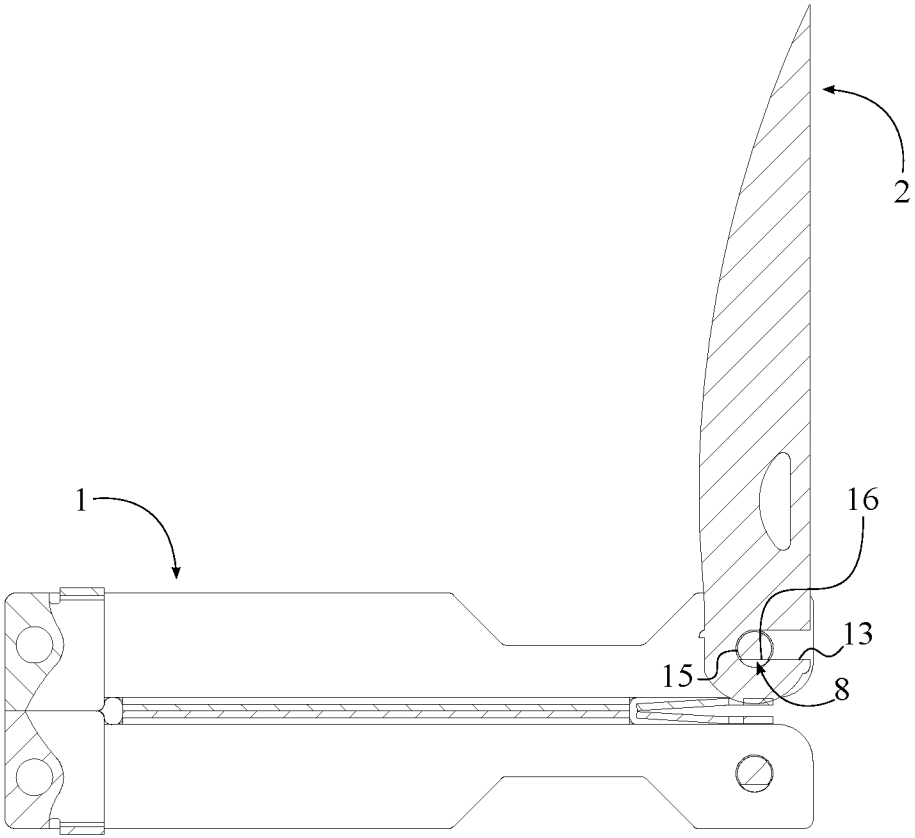
FIG. 20 is a cross section view of the present invention taken along line G-G of FIG. 18, showing the positioning of the utility tool within the unlocked position.

In reference to FIG. 18-20, the attachment channel 7 and the D-shaped pivot pin 14 are configured into an unlocked position that allows the insertion and removal of the utility tool 2 while the utility tool 2 is folded out of the handle 1. More specifically, the arc wall 15 is concentrically encircled within the circular section 8 so that the D-shaped pivot pin 14 is able to rotate about the circular section 8 of the attachment channel 7. However, the straight wall 16 is positioned parallel to the second lengthwise edge 13 of the rectangular section 11 as the straight wall 16 is positioned coincident to the second lengthwise edge 13. Since the height 24 of the arc wall 15 is smaller than the distance 23 between the first lengthwise edge 12 and the second lengthwise edge 13 and the first lengthwise edge 12 is tangentially positioned to the first half 9, the utility tool 2 can be easily removed from the D-shaped pivot pin 14 when the utility tool 2 and the handle 1 are positioned perpendicular to each other.

The present invention preferably comprises a leaf-spring locking mechanism which locks the utility tool in desired position. In other words, the leaf-spring locking mechanism locks the utility tool 2 when the utility tool 2 is folded within the handle 1 or fully extended out of the handle 1. The leaf-spring locking mechanism comprises a leaf spring platform, a first engagement teeth, a second engagement teeth, and an opening. More specifically, the leaf spring platform is terminally connected to the handle 1 and generally positioned adjacent to the D-shaped pivot pin 14. Furthermore, the connection between the handle 1 and the leaf spring platform delineates the opening in between the handle 1 and the leaf spring platform. The first engagement teeth and the second engagement teeth are oppositely positioned of each other about the utility tool 2 and connected to the main body 3. As a result, when the utility tool 2 is folded within the handle 1, the first engagement teeth is engaged within the opening thus locking the utility tool 2. However, when the utility tool 2 is outwardly rotated about the D-shaped pivot pin 14, a curved end of the utility tool 2 pushed down on the leaf spring platform and disengaged the first engagement teeth from the opening. Similarly, when the utility tool 2 is fully extended out of the handle 1, the second engagement teeth is engaged within the opening thus locking the utility tool 2. However, when the utility tool 2 is inwardly rotated about the D-shaped pivot pin 14, the curved end of the utility tool 2 pushed down on the leaf spring platform and disengaged the second engagement teeth from the opening. Even though the present invention utilizes the leaf-spring locking mechanism as the preferred locking mechanism, the present invention can utilize any other type of locking mechanisms that is known within the multitool industry.

Although the invention has been explained in relation to its preferred embodiment, it is to be understood that many other possible modifications and variations can be made without departing from the spirit and scope of the invention as hereinafter claimed.

What is claimed is:

1. A modular tool apparatus comprising:

at least one handle;

at least one utility tool;

at least one attachment channel;

at least one D-shaped pivot pin;

the D-shaped pivot pin being rotatably connected to the handle;

the attachment channel laterally traversing into the utility tool;

the attachment channel being rotatably engaged around the D-shaped pivot pin;

the utility tool being foldably attached to the handle through the attachment channel and the D-shaped pivot pin;

the attachment channel comprising a circular section and a rectangular section;

the circular section being concentrically positioned onto a longitudinal axis of the utility tool;

the circular section traversing through a main body of the utility tool;

the rectangular section laterally traversing into the main body of the utility tool;

the rectangular section being extended into the longitudinal axis;

the circular section comprising a first half and a second half;

the rectangular section comprising a first lengthwise edge and a second lengthwise edge;

the first lengthwise edge and the second lengthwise edge being positioned parallel to each other;

the first lengthwise edge being tangentially positioned to the first half;

the second lengthwise edge being laterally intercepted about the second half; and a diameter of the circular section being larger than a distance between the first lengthwise edge and the second lengthwise edge.

2. The modular tool apparatus as claimed in claim 1 comprising:

the utility tool comprising a main body, a longitudinal axis, a fixed end, and a free end;

the fixed end and the free end being oppositely positioned of each other about the main body;

the longitudinal axis being extended through the fixed end and the free end;

the attachment channel being positioned adjacent to the fixed end; and the free end being positioned offset of the D-shaped pivot pin.

3. The modular tool apparatus as claimed in claim 1 comprising:

a cross section of the D-shaped pivot pin comprising an arc wall and a straight wall; and the straight wall being terminally connected to the arc wall.

4. The modular tool apparatus as claimed in claim 3, wherein the arc wall is a major arc.

5. The modular tool apparatus as claimed in claim 1 comprising:

at least one lever; and the lever being terminally connected to the D-shaped pivot pin.

6. The modular tool apparatus as claimed in claim 5 comprising:

the lever comprising a longitudinal axis, a first end, and a second end;

the first end and the second end being oppositely positioned of each other about the lever;

the longitudinal axis being extended though the first end and the second end;

the first end being terminally connected to the D-shaped pivot pin; and the longitudinal axis being positioned parallel to a straight wall of the D-shaped pivot pin.

7. The modular tool apparatus as claimed in claim 1 comprising:

the attachment channel comprising a rectangular section;

a cross section of the D-shaped pivot pin comprising an arc wall and a straight wall;

a height of the arc wall being perpendicularly positioned to the straight wall;

the cross section of the D-shaped pivot pin being bisected by the height of the arc wall; and the height of the arc wall being smaller than a distance between a first lengthwise edge and a second lengthwise edge of the rectangular section.

8. The modular tool apparatus as claimed in claim 1 comprising:

wherein the attachment channel and the D-shaped pivot pin being configured into a first locked position;

the attachment channel comprising a circular section and a rectangular section;

a cross section of the D-shaped pivot pin comprising an arc wall and a straight wall;

the arc wall being concentrically encircled within the circular section; and the straight wall being angularly positioned to a second lengthwise edge of the rectangular section.

9. The modular tool apparatus as claimed in claim 1 comprising:

wherein the attachment channel and the D-shaped pivot pin being configured into a second locked position;

the attachment channel comprising a circular section and a rectangular section;

a cross section of the D-shaped pivot pin comprising an arc wall and a straight wall;

the arc wall being concentrically encircled within the circular section;

the straight wall being positioned parallel to a second lengthwise edge of the rectangular section; and the straight wall being positioned offset to the second lengthwise edge.

10. The modular tool apparatus as claimed in claim 1 comprising:

wherein the attachment channel and the D-shaped pivot pin being configured into an unlocked position;

the attachment channel comprising a circular section and a rectangular section;

a cross section of the D-shaped pivot pin comprising an arc wall and a straight wall;

the arc wall being concentrically encircled within the circular section;

the straight wall being positioned parallel to a second lengthwise edge of the rectangular section; and the straight wall being positioned coincident to the second lengthwise edge.

11. A modular tool apparatus comprising:

at least one handle;

at least one utility tool;

at least one attachment channel;

at least one D-shaped pivot pin;

the D-shaped pivot pin being rotatably connected to the handle;

the attachment channel laterally traversing into the utility tool;

the attachment channel being rotatably engaged around the D-shaped pivot pin;

the utility tool being foldably attached to the handle through the attachment channel and the D-shaped pivot pin;

at least one lever;

the lever being terminally connected to the D-shaped pivot pin;

the lever comprising a longitudinal axis, a first end, and a second end;

the first end and the second end being oppositely positioned of each other about the lever;

the longitudinal axis being extended though the first end and the second end;

the first end being terminally connected to the D-shaped pivot pin; and the longitudinal axis being positioned parallel to a straight wall of the D-shaped pivot pin.

12. The modular tool apparatus as claimed in claim 11 comprising:

the utility tool comprising a main body, a longitudinal axis, a fixed end, and a free end;

the fixed end and the free end being oppositely positioned of each other about the main body;

the longitudinal axis being extended through the fixed end and the free end;

the attachment channel being positioned adjacent to the fixed end; and the free end being positioned offset of the D-shaped pivot pin.

13. The modular tool apparatus as claimed in claim 11 comprising:

the attachment channel comprising a circular section and a rectangular section;

the circular section being concentrically positioned onto a longitudinal axis of the utility tool;

the circular section traversing through a main body of the utility tool;

the rectangular section laterally traversing into the main body of the utility tool; and the rectangular section being extended into the longitudinal axis.

14. The modular tool apparatus as claimed in claim 13 comprising:

the circular section comprising a first half and a second half;

the rectangular section comprising a first lengthwise edge and a second lengthwise edge;

the first lengthwise edge and the second lengthwise edge being positioned parallel to each other;

the first lengthwise edge being tangentially positioned to the first half;

the second lengthwise edge being laterally intercepted about the second half; and a diameter of the circular section being larger than a distance between the first lengthwise edge and the second lengthwise edge.

15. The modular tool apparatus as claimed in claim 11 comprising:

a cross section of the D-shaped pivot pin comprising an arc wall and a straight wall; and the straight wall being terminally connected to the arc wall.

16. The modular tool apparatus as claimed in claim 15, wherein the arc wall is a major arc.

17. The modular tool apparatus as claimed in claim 11 comprising:

the attachment channel comprising a rectangular section;

a cross section of the D-shaped pivot pin comprising an arc wall and a straight wall;

a height of the arc wall being perpendicularly positioned to the straight wall;

the cross section of the D-shaped pivot pin being bisected by the height of the arc wall; and the height of the arc wall being smaller than a distance between a first lengthwise edge and a second lengthwise edge of the rectangular section.

18. The modular tool apparatus as claimed in claim 11 comprising:

wherein the attachment channel and the D-shaped pivot pin being configured into a first locked position;

the attachment channel comprising a circular section and a rectangular section;

a cross section of the D-shaped pivot pin comprising an arc wall and a straight wall;

the arc wall being concentrically encircled within the circular section; and the straight wall being angularly positioned to a second lengthwise edge of the rectangular section.

19. The modular tool apparatus as claimed in claim 11 comprising:

wherein the attachment channel and the D-shaped pivot pin being configured into a second locked position;

the attachment channel comprising a circular section and a rectangular section;

a cross section of the D-shaped pivot pin comprising an arc wall and a straight wall;

the arc wall being concentrically encircled within the circular section;

the straight wall being positioned parallel to a second lengthwise edge of the rectangular section; and the straight wall being positioned offset to the second lengthwise edge.

20. The modular tool apparatus as claimed in claim 11 comprising:

wherein the attachment channel and the D-shaped pivot pin being configured into an unlocked position;

the attachment channel comprising a circular section and a rectangular section;

a cross section of the D-shaped pivot pin comprising an arc wall and a straight wall;

the arc wall being concentrically encircled within the circular section;

the straight wall being positioned parallel to a second lengthwise edge of the rectangular section; and the straight wall being positioned coincident to the second lengthwise edge.

* * * * *